US005413123A

United States Patent [19]

Aylott, deceased et al.

[11] Patent Number: 5,413,123

[45] Date of Patent: May 9, 1995

[54] ARTIFICIAL NAIL TIP

[76] Inventors: David H. Aylott, deceased, late of Avon; by Zena M. Aylott, beneficiary, The Old Hundred Barn, Tormarton, Badminton, Avon, GL9 1JA, both of United Kingdom

[21] Appl. No.: 87,726

[22] PCT Filed: Jan. 6, 1992

[86] PCT No.: PCT/GB92/00023

§ 371 Date: Aug. 3, 1993

§ 102(e) Date: Aug. 3, 1993

[87] PCT Pub. No.: WO92/11784

PCT Pub. Date: Jul. 23, 1992

[30] Foreign Application Priority Data

Jan. 5, 1991 [GB] United Kingdom ..... 9100197

[51] Int. Cl.[6] ..... A61M 1/06

[52] U.S. Cl. ..... 132/73; 132/285

[58] Field of Search ..... 132/73, 73.5, 285

[56] References Cited

U.S. PATENT DOCUMENTS

| | | | |
|---|---|---|---|
| D. 299,878 | 2/1989 | Wienslaw . | |
| D. 303,161 | 8/1989 | Tomkins . | |
| 3,487,831 | 1/1970 | Jaume et al. | 132/73 |
| 3,750,684 | 8/1973 | Russell . | |
| 4,135,526 | 1/1979 | Matranga et al. . | |
| 4,408,622 | 10/1983 | Meyerhoefer et al. . | |
| 4,445,234 | 5/1984 | Ogunro | 132/73 |
| 4,511,608 | 4/1985 | Ferraro | 132/73 |
| 4,559,055 | 12/1985 | Ogunro | 132/73 |
| 4,596,260 | 6/1986 | Giuliano . | |
| 4,627,453 | 12/1986 | Isler . | |
| 5,005,595 | 4/1991 | Aylott . | |
| 5,127,414 | 7/1992 | Mast et al. . | |

FOREIGN PATENT DOCUMENTS

| | | |
|---|---|---|
| 288080 | 7/1965 | Australia . |
| 0167329 | 1/1986 | European Pat. Off. . |
| 2271788 | 12/1975 | France . |
| 2451724 | 10/1980 | France . |
| 637050 | 5/1950 | United Kingdom . |
| 662080 | 11/1951 | United Kingdom . |
| 752960 | 7/1954 | United Kingdom . |
| 2146898 | 5/1985 | United Kingdom . |

OTHER PUBLICATIONS

Modern Salon, 3 . 87, p. 147—Left; Acrylic Tips No. 4.

*Primary Examiner*—John G. Weiss

*Attorney, Agent, or Firm*—Stroock & Stroock & Lavan

[57] ABSTRACT

An artificial fingernail tip having a body portion with an underside surface and outer surface. The underside and outer side surfaces extend between a leaning and a trailing end. A security element is positioned between the leading end and the trailing end and extends from the underside of the body portion and towards the trailing end. The security element is a projection constructed to define a slot which receives a user's natural fingernail to resist attachment.

3 Claims, 1 Drawing Sheet

ARTIFICIAL NAIL TIP

This invention relates to an artificial nail tip for enhancing the appearance of a natural fingernail.

Pre-formed artificial nail tips are well known and are usually designed to be placed on top of a natural fingernail of a user with the artificial nail tip extending beyond the end of the natural nail and being secured in position by suitable adhesive. In order to facilitate fixture, the trailing end of the artificial nail tip is either made slightly thinner than the leading end of the nail tip or the nail tip is provided with a shoulder on the inner surface of the artificial nail tip which abuts up against the end of the natural fingernail.

In the prior arrangement disclosed, once secured in position, the junction between the artificial nail tip and the natural fingernail is coated with filler so as to provide a smooth appearance.

A problem with existing artificial nail tips, as opposed to artificial fingernails is that they are more susceptible to damage and to becoming detached because of the relatively small area of adhesive securement to the natural fingernail. With artificial fingernails, the artificial fingernail is secured to substantially the whole of the top of the natural nail by adhesive and therefore this has not been a real problem. However, in respect of artificial fingernails, it has been proposed to provide the underside of the projecting end of the artificial fingernail with a pocket which encloses the projecting tip of the natural nail so as to help prevent displacement. Such an artificial fingernail is disclosed in U.K. Patent Specification No. 662080.

However, in practice, the proposal of a securing pocket was never adopted because the trailing end of an artificial fingernail is adapted to fit against, or just under, the user's cuticle. As users have different sizes of nails, a pocket would always be in the wrong position for ensuring that the trailing end of the artificial fingernail was properly positioned. The proposal in U.K. Specification No. 662080 does attempt to deal with this problem by providing transverse weakening lines across the pocket so that portions of the pocket could be detached, but this did not prove acceptable and artificial fingernails are formed without any such arrangement. Moreover, the proposal did not have regard to moulding practicalities and, in practice, an artificial finger nail having a pocket of this type would be extremely difficult to injection mould. Accordingly, with these disadvantages, the industry, having considered this type of arrangement as impractical for artificial fingernails, has been directed away from this type of security fixture and towards increasing adhesion of the applied artificial fingernail tip as disclosed in, for example, U.S. Pat. No. 4,596,260.

An object of the present invention is to provide an improved artificial nail tip which helps prevent detachment, for example, when the point of the artificial nail tip is caught on an article.

According to the present invention, there is provided an artificial nail tip for bonding to a user's natural fingernail so as to extend beyond the end thereof whilst leaving a portion of the upper surface of the natural fingernail exposed, the nail tip comprising a body having underside and outer surfaces extending between a leading end and a trailing end and a shoulder on the body defining a thinner body portion adjacent the trailing end of the body and which, in use, abuts the free end of a user's natural fingernail, characterized in that the shoulder is on the underside surface of the body, and a projection extends rearwardly from a central position on the shoulder whereby, in use, the projection may be engaged under a user's natural fingernail to resist detachment.

The body of the artificial nail tip is suitably arched to meet the normal curvature of a natural fingernail. Preferably, the projection extends laterally a distance substantially less than the lateral extension of the artificial nail tip to facilitate injection molding.

The invention also includes an artificial nail tip comprising:

a body having underside and outer surfaces extending between a leading end and a trailing end, the body being arched to conform to the normal curvature of a natural fingernail, and a shoulder on the body defining a thinner body portion adjacent the trailing end of the body, characterized in that the shoulder is provided on the underside surface of the body, and a security projection is positioned substantially at the center of the shoulder on the underside surface of the body and comprises a first portion extending away from the underside surface substantially at right angles and a second portion extending rearwardly from the free end of the first portion to define a slot open towards the trailing end and the back of which is co-extensive with the shoulder, the security projection extending laterally a distance substantially less than the lateral extension of the body of the nail tip end, in use, is engaged underneath the tip of the user's natural fingernail which is located within the slot with the natural nail butted up against the shoulder and the back of the slot and the thinner portion of the artificial nail tip overlying the natural nail.

The invention will now be described by way of example with reference to the accompanying drawings in which.

Figure 1:
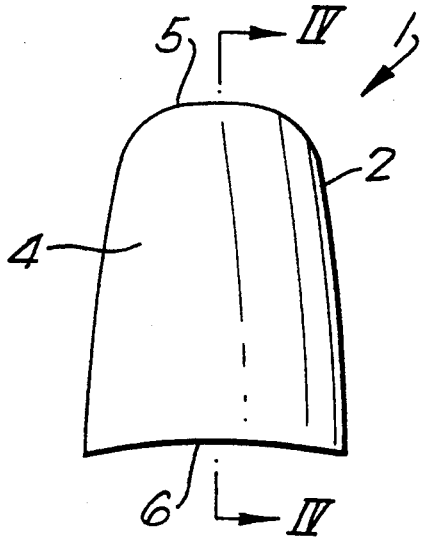
FIG. 1 is a plan view of an artificial nail tip in accordance with the invention.
Figure 2:
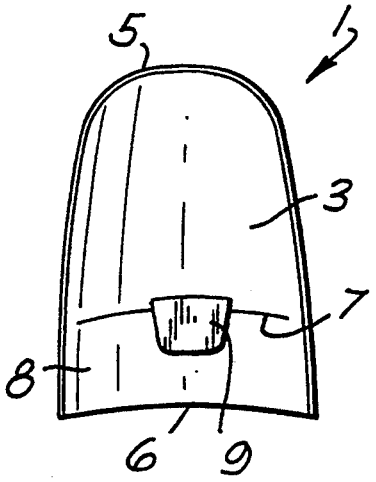
FIG. 2 is an underneath plan view of the artificial nail tip shown in FIG. 1.
Figure 3:
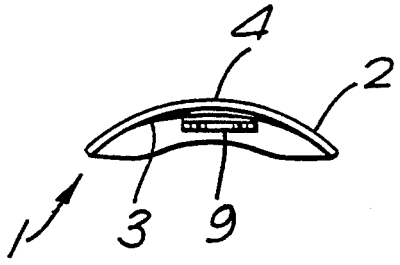
FIG. 3 is an end view.
Figure 4:
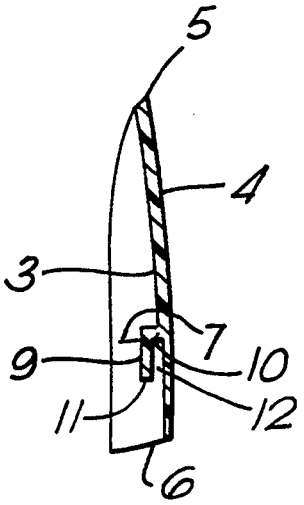
FIG. 4 is a side section on IV on IV in FIG. 1.
Figure 5:
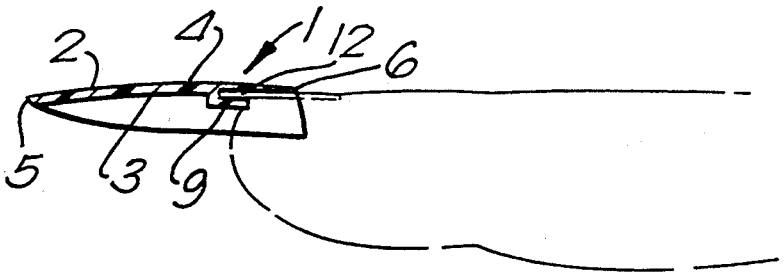
FIG. 5 is a diagrammatic view showing the artificial nail tip as applied to a user's natural fingernail.

In the drawings, an artificial nail tip (1) comprises a body portion (2) having underside and outer surfaces (3,4). The body portion (2) has a leading edge (5) and a trailing edge (6) and is slightly arched in order to match the normal curvature of a natural fingernail. The underside surface (3) of the artificial nail tip (1) is provided with a shoulder (7) defining a thinner portion (8) adjacent the trailing edge (6) of the nail tip (1).

Projecting rearwardly from the center of the shoulder (7) on the underside surface (3) is a security projection (9) which has a relatively small lateral extension relative to the lateral extension of the body of the nail tip (1). The projection (9) comprises a first portion (10) extending away from the underside surface (3) substantially at right angles and a second portion (11) extending rearwardly from the free end of the first portion. The two portions (10, 11) together define a slot (12) open towards the trailing end (6) and the back of which is co-extensive with the shoulder (7).

In use, the thinner portion (8) of the underside surface of the nail tip (1) is coated with adhesive. The artificial nail tip (1) is then applied to the end of the natural fingernail with the security projection (9) engaged underneath the tip of the user's natural fingernail. The natural fingernail is located within the slot (12) with the natural nail butted up against the shoulder (7) and the back of the slot (12) and the thinner portion (8) of the artificial nail tip (1) overlying the natural nail. Once secured in position, the trailing edge (6) of the nail tip is lightly buffed and then the portion of exposed natural nail is filled back to the cuticle with a quick-setting gel painted onto the nail. The user's fingernail is then shaped and painted in normal manner.

The adhesive applied to the underside of the artificial nail tip may either be an instant glue applied separately, or adhesive may already be applied to the thinner portion of the nail tip exposed on use by removal of a protective liner, or a separate adhesive tab may be shaped and used for this purpose. The separate adhesive tab may be formed from a layer of adhesive sandwiched between removable protective liners and may be cut to shape from a sheet or preformed as an individual tab for each nail tip as desired.

The artificial nail tips are suitably provided in a set of nail tips of various sizes to accommodate the different sizes of nails of users. The set of artificial nail tips would also be supplied with a suitable adhesive as aforesaid, a gel with a fast-acting dryer, and a buffer.

The artificial nail tip of the present invention provides the user with a much stronger fixture than prior nail tips and does not suffer the disadvantages previously encountered with artificial fingernails.

I claim:

1. An artificial nail tip for attaching to a natural fingertip of a user comprising:

a body having underside and outer surfaces extending between a leading end and a trailing end, the body having a lateral extension which is arched to conform to the curvature of the natural fingernail, a shoulder on the body defining a thinner body portion adjacent the trailing end of the body, the shoulder being provided on the underside surface of the body, and a security projection positioned substantially at the center of the shoulder on the underside surface of the body, said security projection comprising a first portion extending away from the underside surface substantially at a right angle and a second portion extending rearwardly to the trailing end and from a free end of the first portion to define a slot open towards the trailing end, the security projection extending laterally a distance substantially less than the lateral extension of the body of the nail tip, whereby the security projection in use is engaged underneath the tip of the user's natural fingernail which is located within the slot with the natural fingernail butted up against the shoulder and the back of the slot and the thinner portion of the artificial nail tip overlying the natural fingernail.

2. The artificial nail tip according to claim 1, including a layer of adhesive applied to the thinner portion of the nail tip body, said layer of adhesive being exposed by the removal of a protective liner.

3. The artificial nail tip according to claim 1, further including adhesive means for securing the nail tip in position, said adhesive means including a layer of adhesive sandwiched between first and second releasable protective liners.

* * * * *